United States Patent [19]

Neeld et al.

[11] 4,021,858

[45] May 10, 1977

[54] FACE MASK

[76] Inventors: Gregory Patrick Neeld; Norman George Neeld, both of 1210 Taylor Way, West Vancouver, British Columbia, Canada, V7T 2K3

[22] Filed: Mar. 11, 1976

[21] Appl. No.: 665,949

[52] U.S. Cl. ..... 2/9

[51] Int. Cl.[2] ..... A41D 13/00

[58] Field of Search ..... 2/9, 10, 6, 3 R, 173, 2/427

[56] References Cited

UNITED STATES PATENTS

| | | | |
|---|---|---|---|
| 2,686,912 | 8/1954 | Shipman | 2/9 |
| 2,718,006 | 9/1955 | Bowers, Sr. | 2/10 |
| 3,009,158 | 11/1961 | Comeau et al. | 2/6 X |
| 3,113,318 | 12/1963 | Marietta | 2/9 |
| 3,274,613 | 9/1966 | Sowle | 2/9 |
| 3,897,597 | 8/1975 | Kasper | 2/9 |

*Primary Examiner*—Werner H. Schroeder
*Assistant Examiner*—Peter Nerbun
*Attorney, Agent, or Firm*—Fulwider, Patton, Rieber, Lee & Utecht

[57] ABSTRACT

A face mask for use with a protective helmet, particularly a hockey helmet. The mask comprises a main support member adapted to be attached to the helmet at each of its upper ends and shaped to extend down each side of the face of a wearer of the helmet and under the chin. A cage extends outwardly from the main support member and across the lower face and under the chin of the wearer to protect the lower face. Lower attachment means attach the face mask to the helmet at a point remote from its attachment to the main support member. A transparent, break-resistent screen to protect the eyes and upper face is attached to the main support member. The bottom edge of the screen is close to the upper edge of the cage.

15 Claims, 4 Drawing Figures

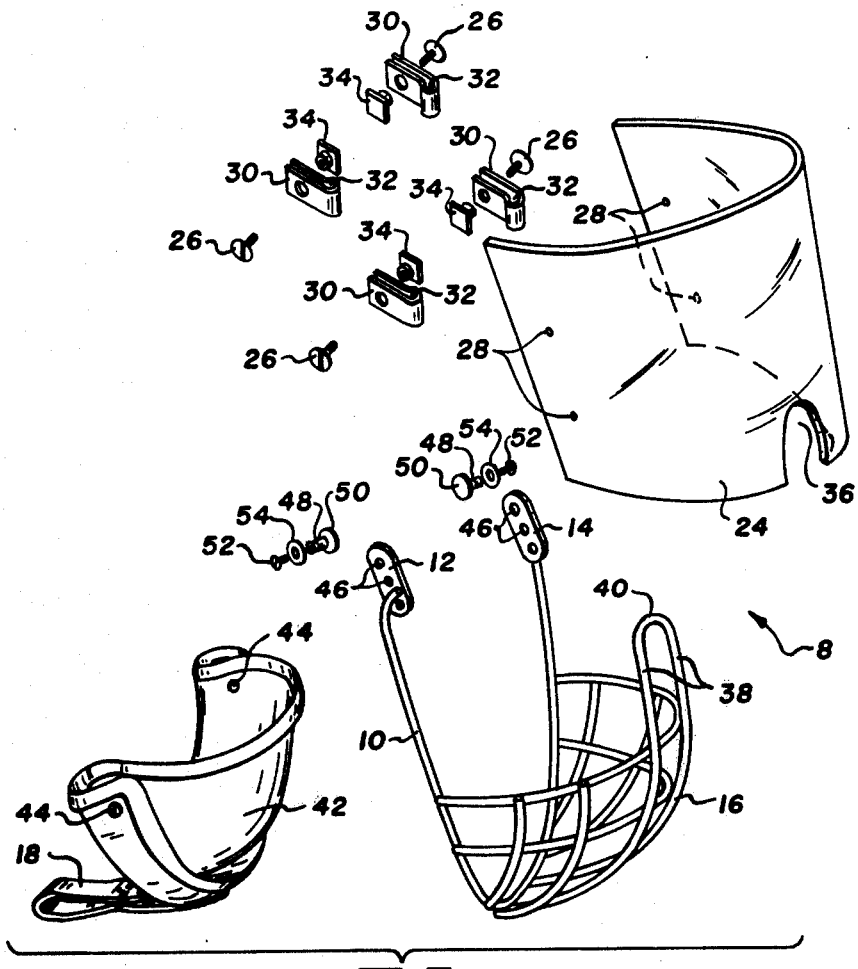
Fig. 3.
Fig. 4.
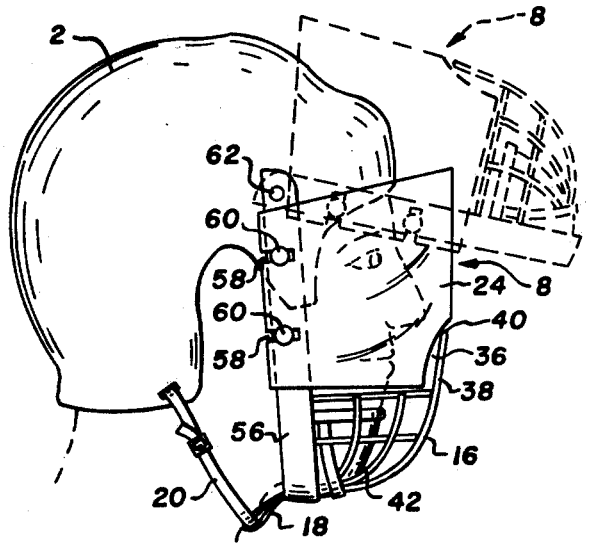

FACE MASK

FIELD OF THE INVENTION

This invention relates to a face mask for use with a protective helmet and, in particular, to a face mask for use with a hockey helmet.

DESCRIPTION OF PRIOR ART

It has long been required of amateur hockey players to wear helmets. In view of injuries received to the face and eyes of hockey players, there is an increasing tendency for young players to wear face masks in conjunction with these helmets. At present these face masks vary from quite simple bars such as, for example, used on a football helmet to face covering metal cages and plastic masks that protect the nose and eyes. Most young hockey players are also required to wear a mouth guard.

The attachment of these face protecting devices is usually satisfactory for younger players and their mounting to the hockey helmet is rather simple. Usually it comprises four bolts attached either two at each side or the helmet or one at each side of the helmet and one or two bolts on the front of the helmet. None of these schemes are deemed to be appropriate for hockey at, for example, junior level where the vigour of play is such that the masks can easily be knocked from a player's face. The schemes are believed to be completely inappropriate for use at the professional level.

SUMMARY OF INVENTION

The present invention seeks to provide a face mask for use with a protective helmet. The mask of this invention is extremely robust and well able to stand use in professional hockey.

Accordingly, the present invention is a face mask for use with a protective helmet the mask comprising a main support member adapted to be attached to the helmet at each of its upper ends and shaped to extend down each side of the face of a wearer of the helmet and under the chin, a cage extending outwardly from the main support member and across the lower face and under the chin of the wearer to protect the lower face, lower attachment means to attach the face mask to the helmet at a point remote from the mask's attachments to the main support member, and a transparent, breakresistant screen, to protect the eyes and upper face, attached to the main support member and whose bottom edge is close to the upper edge of the cage.

It is desirable that the main support member be pivotally attached to the helmet at each of its upper ends. With this embodiment of the invention when a hockey player is sitting on the bench he can disengage the lower attachment means and pivot the mask upwardly about the upper, pivotal attachment.

Desirably, the lower attachment means of the helmet comprises a strap extending from the base of the cage and provided with snap-on clips that engage with corresponding clips positioned on the side of the helmet. In a useful embodiment, a loop can extend backwardly from the bottom of the cage and the face mask can be provided with a strap with clips at each of its ends that engage with the loop and extend backwardly to engage corresponding clips on each side of the helmet. The loop can also be built into the cage, for example, by bending parts of the cage outwardly from the cage.

BRIEF DESCRIPTION OF THE DRAWINGS

The embodiments of the invention are illustrated by way of example, in the accompanying drawings in which:

FIG. 3 is an exploded view of the face mask shown in FIGS. 1 and 2; and FIG. 4 illustrates a further embodiment of the present invention.

DESCRIPTION OF PREFERRED EMBODIMENTS

Figure 1:
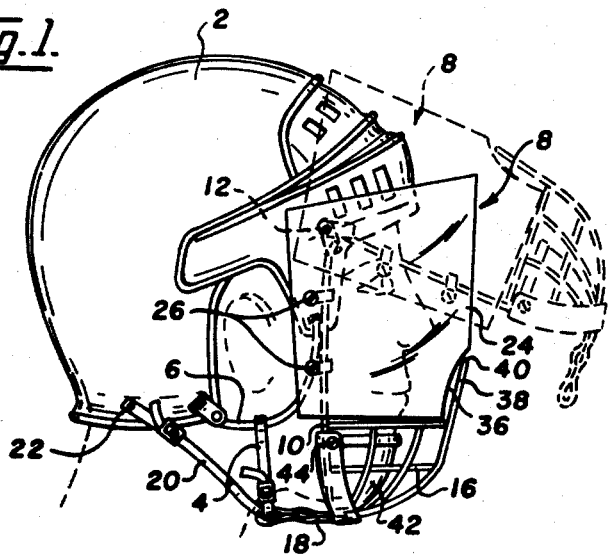
FIG. 1 illustrates a face mask according to the present invention attached to a helmet worn by a player.

FIG. 1 illustrates a conventional hockey helmet 2 provided with a chin strap 4 that engages with loops 6 so that the helmet may be firmly attached to the head of the wearer. The helmet 2, the strap 4 and the loop 6 are conventional and form no part of the present invention.

The helmet is shown equipped with a face mask, generally indicated at 8, according to the present invention. Face mask 8 comprises a main support member 10 that is attached to the helmet at each of its upper ends 12 and 14 (see particularly FIG. 2) and shaped to extend down the sides of the face of a wearer of the helmet 2 and under the chin of the wearer.

A cage 16 extends outwardly from the main support member 10, across the lower face and under the chin of the wearer to protect the lower face. The mask 8 has lower attachment means comprising a loop 18 extending backwardly from the bottom of the cage 16. A strap 20 engages in the loop 18 and is provided with snap-on clips 22 at each of its ends (only one of which is shown in FIG. 1) to engage with corresponding clips provided on the sides of the helmet 2. Snap-on clips are well known in hockey equipment such as mouth guards and helmets. They are usually made of nylon. Loop 18 may be replaced by curving the center members of the cage 16 outwardly away from the face, to form a catch to be engaged by the strap 20.

The face mask 8 is also provided with a transparent, break-resistant screen 24 to protect the eyes and upper face. The screen is attached to the main support member 10 by bolts 26 each passing through a hole 28 formed in the screen 24—see particularly FIG. 3. The bolts extend through brackets 30 provided with circular end portions 32 able to grip the support member 10. The bolts 26 are tightened into nuts 34. The effect of this is to compress the circular end portions 32 of the brackets 30 around the support member 10 to locate the mask in position.

Screen 24 is provided with an opening 36 positioned in the vicinity of the nose and mouth of a wearer. This facilitates breathing and reduces the tendency of the mask to mist. However, to prevent entry of an object of appreciable size through the hole, for example, a hockey stick blade or a puck, cage 16 is provided with upwardly extending lugs 38 joined by a cross member 40. The configuration of the lugs 38 and of the cross member 40 is not important. It is desirable that they be as small as possible consistent with their function of preventing entry of an object of appreciable size through the hole 36.

Figure 2:
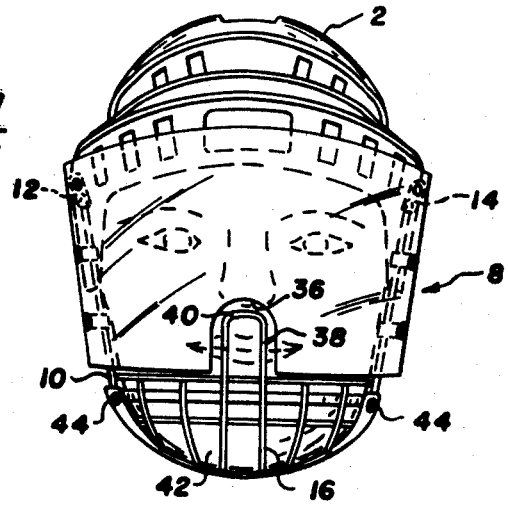
FIG. 2 is a front view of the face guard and helmet as illustrated in FIG. 1.

As most clearly indicated in FIG. 3 the mask of FIGS. 1 to 3 is provided with a cup 42 that rests against the chin of the wearer. The cup 42 is provided with clips 44 so that the cup can be folded around the cage 16 and clipped into position around the support member--see FIG. 1. The cup 42 may be of leather or synthetic leather or of an injection moulded, foamed resin, for example polyurethane. As illustrated most clearly in FIG. 3, the loop 18 can be formed as a part of the cup 42.

As indicated in FIG. 3, the upper ends 12 and 14 of the face mask of FIGS. 1 to 3 are made up of flat plates each formed with a plurality of holes 46. The holes 46 engage with a sleeve 48 formed integrally with a nut 50 that engages with a bolt 52 to attach the face mask 8 to the helmet 2. Washers 54 are desirably provided between the upper ends 12 and 14 and the nut 50 to facilitate the pivoting action of the helmet.

The face mask is illustrated in FIGS. 1 to 3 as being attached to the support member 10 by bolts 26 cooperating with bracket 32 and nuts 34. However, this arrangement can be replaced by the use of clips engaging the edge of the screen 24 and also being attached to the support member 10. This avoids cutting or drilling of the face mask, for example, as is required in forming holes 28.

The plurality of holes 46 in the upper ends 12 and 14 of the support member 10 means that the face mask can be adapted for varying sizes of face simply by selecting the appropriate hole. An upper hole will be used for longer faces and the lower holes for shorter faces. However, instead of a plurality of holes 46 a telescopic arrangement can be used for the support member 10. That is, at each side of the mask the support member 10 is divided and one part telescopes into the other. A set screw or the like projecting through the outer section to abut the inner can maintain the telescoped parts in a desired position.

Alternatively the support member 10 can be divided on each side of the mask. Each end is fitted into a tubular section provided with threaded holes to receive set screws. These set screws grip the support member 10. Adjustment for length is thus carried out by loosening the set screws, moving the divided support members 10 until the length of the mask is correct, then tightening the set screws. Desirably the tubular sectio is attached to a plate to permit location of the screen 24. The plate is provided with holes to correspond to holes 28 in the screen 24. Bolts positioned through the holes in the plate and through corresponding holes 28 are located by nuts to locate the screen relative to the supports 10.

FIG. 4 illustrates an embodiment of the invention that resembles the embodiment illustrated in FIGS. 1 to 3 so that similar numbers are used for similar parts. However, the support member 10 of FIGS. 1 to 3 is replaced by a flat bar 56 in FIG. 4 that imparts greater strength to the face masks. Furthermore, in the embodiment of FIG. 4 the screen 24 is mounted on the flat bar 56 by the formation of slots 58 that engage with bolts 60. The flat bar 56 may be provided with threaded holes (not shown) to engage the bolts 60 or nuts may be provided on the inside of the flat bar 56. The remainder of the face mask is essentially the same as that illustrated in FIGS. 1 to 3. As illustrated in dotted outlines in FIG. 4 the face mask of this embodiment may also be pivoted around bolts 62. The fit of this embodiment of the mask can also be varied by dividing flat bar 56 on each side of the mask and providing one part on each side with a sleeve able to telescope over the other part. Set screws can locate the telescoped sections relative to each other. Desirably the inner section is provided with a slot to be engaged by the set screw.

It is desirable that the face mask according to the present invention be light yet robust. It has been found desirable to make the screen 24 of polycarbonate resin, typically ⅛ to 3/16 inches thick. Cage 16 may be of steel, for example of 10 gauge rod preferably plated with a synthetic resin, but may also be made of a reinforced synthetic resin of the appropriate strength. For example, a graphite reinforced epoxy resin combines lightness with great strength and is an ideal material for the cage 16. Support members 10 are typically of 8 gauge steel rod.

The face mask according to the present invention is relatively light and yet provides complete protection to the whole face of a hockey player both against flying pucks and against high sticks.

We claim:

1. A face mask for use with a hockey helmet the mask comprising a main support member, substantially U shaped and adapted to be attached to each side of the helmet at each upper end of the support member, said support member being shaped to extend down each side of the face of the wearer of the helmet and under the chin;

a cage rigidly attached to and extending outwardly from the main support member and across the lower face and under the chin of the wearer to protect the lower face;

lower attachment means to attach the face mask to the helmet at a point remote from the attachment of the main support member to the helmet; and a transparent, substantially U shaped screen of a break resistant material to extend completely around the face of the wearer of the face mask to protect the eyes and upper face of the wearer, and attached to the main support member at each side of the face mask, the screen being positioned to extend so that its upper edge overlaps with the lower edge of the hockey helmet and is spaced from the helmet at its upper edge, the bottom edge being close to the upper edge of the cage to prevent entrance of a relatively small object.

2. A mask as claimed in claim 1 in which the lower attachment means of the helmet comprises a strap extending from the base of the cage and provided with snapon clips that engage with corresponding clips positioned on the side of the helmet.

3. A face mask as claimed in claim 2 in which a loop extends backwardly from the bottom of the cage and in which there is a strap provided with clips at each of its ends, the strap engaging with the loop and extendable backwardly to engage with corresponding clips on each side of the helmet.

4. A helmet as claimed in claim 1 in which the transparent screen is provided with an opening positioned to be in the vicinity of the nose and mouth of a wearer and in which the cage has lugs that extend upwardly to prevent entry of an object of appreciable size through the hole.

5. A face mask as claimed in claim 1 in which the main support member is a flat bar.

6. A face mask as claimed in claim 1 in which the cage has attached to it a cup adapted to contact the chin of a wearer.

7. A mask as claimed in claim 6 in which the cup is provided with clips so that it can be folded around the cage and clipped to locate it on the cage.

8. A face mask as claimed in claim 1 in which the screen is bolted to brackets that engage the main support member.

9. A mask as claimed in claim 1 in which the screen is attached to the main support member by clips.

10. A face mask as claimed in claim 1 provided with slots that engage with bolts attached to the support member.

11. A face mask as claimed in claim 1 in which the cage is of metal.

12. A face mask as claimed in claim 1 in which the cage is of graphite reinforced resin.

13. A face mask as claimed in claim 12 in which the resin is an epoxy resin.

14. A face mask as claimed in claim 1 in which the main support member is provided with a plurality of holes at each of its upper ends so that the position of the face mask on a helmet can be varied to suit varying sizes of faces.

15. A face mask as claimed in claim 1 in which the screen is of a polycarbonate resin.

* * * * *